US005154596A

United States Patent [19]

Schwartz et al.

[11] Patent Number: 5,154,596

[45] Date of Patent: * Oct. 13, 1992

[54] METHODS AND APPARATUS FOR BURNING FUEL WITH LOW $NO_x$ FORMATION

[75] Inventors: Robert E. Schwartz, Tulsa; Richard T. Waibel, Broken Arrow; Paul M. Rodden, Sand Springs; Samuel O. Napier, Sapulpa, all of Okla.

[73] Assignee: John Zink Company, a Division of Koch Engineering Company, Inc., Tulsa, Okla.

[ * ] Notice: The portion of the term of this patent subsequent to Mar. 24, 2009 has been disclaimed.

[21] Appl. No.: 836,779

[22] Filed: Feb. 13, 1992

Related U.S. Application Data

[63] Continuation of Ser. No. 578,953, Sep. 7, 1990, Pat. No. 5,098,282.

[51] Int. Cl.[5] ..... F23M 3/00; F23C 7/00

[52] U.S. Cl. ..... 431/9; 431/116; 431/181; 431/187

[58] Field of Search ..... 431/9, 278, 181, 187, 431/188, 115, 116, 8, 10, 174

[56] References Cited

U.S. PATENT DOCUMENTS

| | | | |
|---|---|---|---|
| 3,174,526 | 3/1965 | Von Linde | 158/4 |
| 3,658,482 | 4/1972 | Evans et al. | 23/277 C |
| 3,716,001 | 2/1973 | Potasek et al. | 110/8 A |
| 3,794,459 | 2/1974 | Meenan | 431/5 |
| 4,004,875 | 1/1977 | Zink et al. | 431/9 |
| 4,130,388 | 12/1978 | Flanagan | 431/116 |
| 4,277,942 | 7/1981 | Egnell et al. | 60/517 |
| 4,481,889 | 11/1984 | Sikander et al. | 110/212 |
| 4,505,666 | 3/1985 | Martin et al. | 431/175 |
| 4,575,332 | 3/1986 | Oppenberg et al. | 431/9 |
| 4,645,449 | 2/1987 | Schwartz et al. | 431/8 |
| 4,699,071 | 10/1987 | Vier et al. | 110/345 |
| 4,708,638 | 11/1987 | Brazier et al. | 431/116 |
| 5,044,932 | 9/1991 | Martin et al. | 431/116 |

FOREIGN PATENT DOCUMENTS 89119591.9 10/1989 European Pat. Off. .

*Primary Examiner*—Larry Jones

*Attorney, Agent, or Firm*—Laney, Dougherty, Hessin & Beavers

[57] ABSTRACT

Improved methods and burner apparatus are provided for discharging mixtures of fuel and air into furnace spaces wherein said mixtures are burned and flue gases having low $NO_x$ content are formed therefrom. The methods basically comprise discharging a first fuel mixture containing a portion of the fuel and flue gases from the furnace space into the furnace space whereby the mixture is burned in a primary reaction zone therein and flue gases having low $NO_x$ content are formed therefrom, and then discharging the remaining portion of the fuel into a secondary reaction zone wherein the remaining portion of fuel mixes with air and flue gases to form a second fuel mixture which is burned in the secondary reaction zone and additional flue gases having low $NO_x$ contents are formed therefrom.

13 Claims, 3 Drawing Sheets

METHODS AND APPARATUS FOR BURNING FUEL WITH LOW $NO_x$ FORMATION

This is a continuation of copending application Ser. No. 07/578,953 filed on Sep. 7, 1990, now U.S. Pat. No. 5,098,282.

BACKGROUND OF THE INVENTION

1. Field of the Invention

The present invention relates to methods and apparatus for burning fuel-air mixtures whereby flue gases having low $NO_x$ content are produced.

2. Description of the Prior Art

As a result of the adoption of stringent environmental emission standards by government authorities and agencies, methods and apparatus to suppress the formation of oxides of nitrogen ($NO_x$) in flue gases produced by the combination of fuel-air mixtures have been developed and used heretofore. For example, methods and apparatus wherein fuel is burned in less than a stoichiometric concentration of oxygen to intentionally produce a reducing environment of CO and $H_2$ have been proposed. This concept has been utilized in staged air burner apparatus wherein the fuel is burned in a deficiency of air in a first zone producing a reducing environment that suppresses $NO_x$ formation, and then the remaining portion of air is introduced into a second zone. Methods and apparatus have also been developed wherein all of the air and some of the fuel is burned in a first zone with the remaining fuel being introduced into a second zone. In this staged fuel approach, an excess of air in the first zone acts as a diluent which lowers the temperature of the burning gases and thereby reduces the formation of $NO_x$. Other methods and apparatus have been developed wherein flue gases are combined with fuel-air mixtures to dilute the mixtures and thereby lower their combustion temperatures and the formation of $NO_x$.

While the prior art methods and burner apparatus for producing flue gases having low $NO_x$ content have achieved varying degrees of success, there still remains a need for improvement in such methods and burner apparatus whereby low $NO_x$ content flue gases are produced and simple economical burner apparatus is utilized.

SUMMARY OF THE INVENTION

By the present invention, the above mentioned needs for improved methods of burning fuel-air mixtures and improved burner apparatus for carrying out the methods are met. That is, the present invention provides improved methods and burner apparatus for discharging mixtures of fuel and air into furnace spaces wherein the mixtures are burned and flue gases having low $NO_x$ content are formed therefrom. The methods each basically comprise the steps of mixing a portion of the total fuel needed for the required heat release in the furnace space and flue gases from the furnace space to form a first fuel mixture. The first fuel mixture is discharged into the furnace space whereby it combines with a portion of the total air required for forming an at least substantially stoichiometric total fuel-total air mixture, and the resultant fuel-flue gases-air mixture is burned in a primary reaction zone therein. Because the fuel and air in the mixture are diluted with flue gases and, as a result, burn at a relatively low temperature, low $NO_x$ content flue gases are formed therefrom. The remaining portion of fuel is discharged into a secondary reaction zone in the furnace space wherein it mixes with cooled flue gases contained in the furnace space and air remaining therein to form a second fuel mixture. The second fuel mixture also burns at a relatively low temperature and flue gases having low $NO_x$ content are formed therefrom. The first fuel mixture can optionally contain a portion of the air mixed simultaneously with the fuel and flue gases, and a portion of the air can optionally be separately conducted to and discharged into the secondary reaction zone with the remaining portion of the fuel.

The improved burner apparatus of the present invention which is relatively simple and economical utilizes a primary fuel jet mixer-nozzle assembly for mixing a portion of the fuel and inspirated flue gases drawn from the furnace space and discharging the resultant first fuel mixture into a primary reaction zone in the furnace space. A portion of the air can optionally be inspirated into the primary mixer-nozzle assembly and simultaneously mixed with the first fuel mixture.

The remaining portion of the fuel is discharged into the furnace space by way of one or more secondary fuel nozzles positioned adjacent to the primary nozzle whereby the fuel enters a secondary reaction zone sequentially following the primary reaction zone. A portion of the air flows into the primary reaction zone wherein it combines with the first fuel mixture discharged from the primary mixer-nozzle assembly, and optionally, a portion of the air can be separately conducted to the location of each secondary fuel nozzle utilized whereby air is discharged along with the fuel into the secondary reaction zone.

It is, therefore, a general object of the present invention to provide an improved method and burner apparatus for discharging a mixture of fuel and air into a furnace space wherein the mixture is burned and flue gases having a low $NO_x$ content are formed therefrom.

A further object of the present invention is the provision of an improved low $NO_x$ burner apparatus which is of simple and economical construction.

Other and further objects, features and advantages of the present invention will be readily apparent to those skilled in the art upon a reading of the description of preferred embodiments which follows.

DESCRIPTION OF PREFERRED EMBODIMENTS

Figure 1:
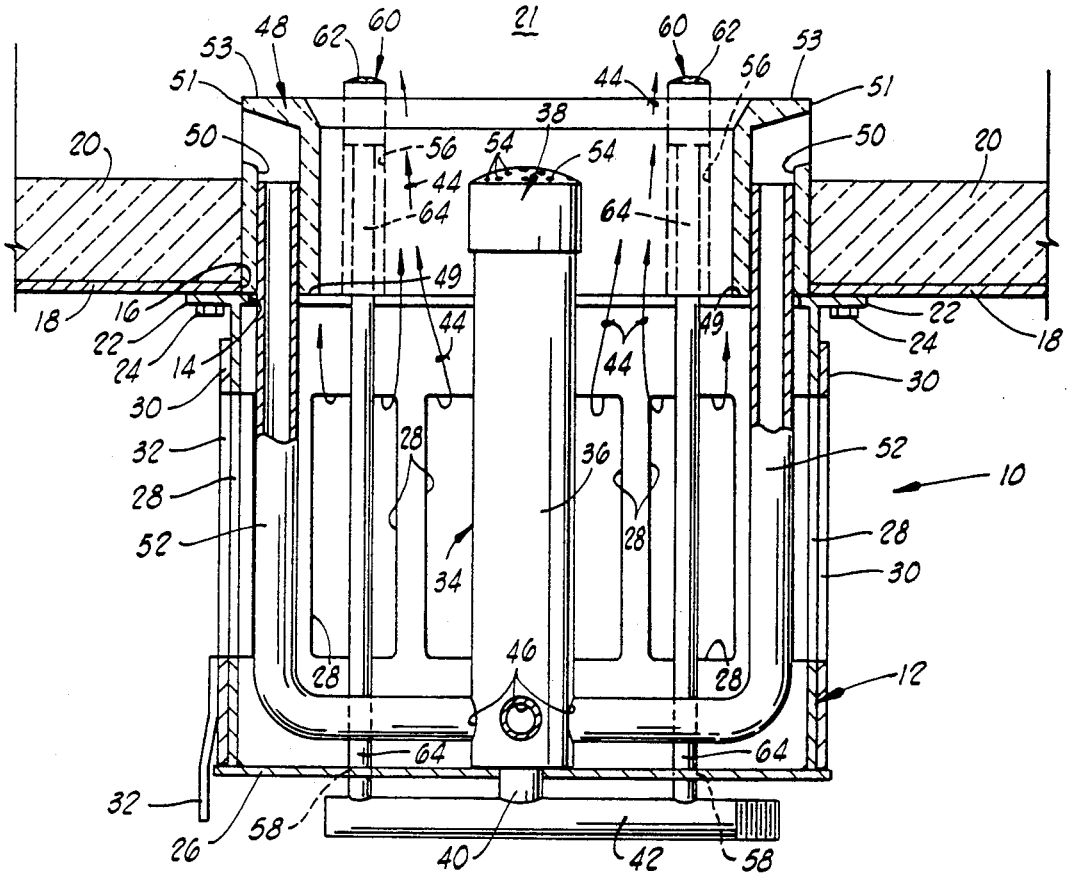
FIG. 1 is a side cross-sectional view of a burner apparatus of the present invention attached to a furnace wall.

Referring now to the drawings, a presently preferred embodiment of burner apparatus of the present invention is illustrated and generally designated by the numeral 10. The burner 10 includes a cylindrical housing 12 which is connected at an open end 14 thereof over a complimentary opening 16 in a furnace wall 18. As will be understood by those skilled in the art, the furnace wall 18 generally includes an internal layer of insulation material 20, and the wall 18 and insulation material 20 together with a portion of the interior of a burner tile 48 which will be described further hereinbelow define a furnace space 21 within which fuel and air are burned to form hot flue gases.

As illustrated in FIG. 1, the burner housing 12 includes an annular flange 22 at the open end 14 thereof. The flange 22 is bolted to the furnace wall 18 by a plurality of bolts 24. The opposite end of the housing 12 is closed by an end wall 26, and a plurality of air inlet openings 28 are disposed in spaced relationship around the cylindrical side of the housing 12. A cylindrical damper 30 is rotatably positioned over the cylindrical side of the housing 12 having a handle 32 attached thereto. The damper 30 includes air openings 32 which are complimentary to the air openings 28 whereby the damper 30 can be rotated, using the handle 32, between a closed position whereby the openings 28 are covered by solid portions of the damper 30, a partially open position and a fully open position whereby the openings 28 are in registration with the openings 32 as shown in FIG. 1.

Positioned co-axially within the housing 12 is a primary fuel jet mixer-discharge nozzle assembly generally designated by the numeral 34. The assembly 34 is comprised of an elongated fuel jet mixer 36 connected to a discharge nozzle 38. The mixer 36 attached to the end plate 26 of the housing 12 includes a pressurized fuel inlet connection (not shown) to which a conduit 40 (via an opening in the end plate 26) is connected. The conduit 40 is in turn connected to a header or conduit 42 which conducts pressurized fuel from a source thereof to the burner 10. The mixer 36 also includes four flue gases inlet connections 46 which are positioned in equally spaced relationship around the base thereof.

Figure 2:
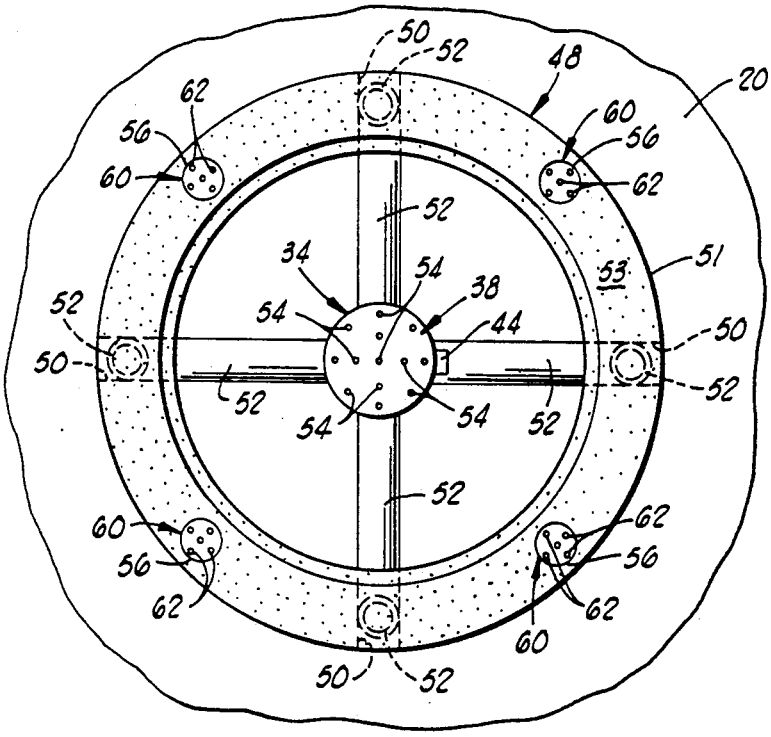
FIG. 2 is a top plan view of the burner and the furnace wall of FIG. 1.

At the open end 14 of the housing 12 is an annular burner tile 48 formed of flame and heat resistant material. As shown in FIGS. 1 and 2, the burner tile 48 includes four passageways 50 which extend from the end 49 thereof adjacent the open end 14 of the housing 12 to the exterior side 51 thereof within the furnace space 21. Connected to each of the flue gases inlet connections 46 of the mixer 36 are the ends of four conduits 52 which are disposed within the housing 12, the other ends of which extend into the passageways 50 formed in the burner tile 48. Thus, the four conduits 52 connect the four flue gases inlet connections 46 of the primary mixer-nozzle assembly 34 to the passageways 50 in the burner tile 48. As best shown in FIG. 2, the passageways 50 with the conduits 52 extending therein are positioned in equally spaced relationship around the primary mixer-nozzle assembly 34. As will be understood, more or less than four conduits 52 and inlet connections 46 may be utilized in the burner apparatus 10 depending upon various design considerations known to those skilled in the art.

The nozzle 38 of the primary mixer-nozzle assembly 34 includes one or more orifices 54 formed therein through which, as will be described further hereinbelow, a mixture of fuel and flue gases is discharged into a primary reaction zone in the furnace space 21.

Four additional passageways 56 are disposed in the burner tile 48 extending from the end 49 thereof to the other end 53 thereof. As best shown in FIG. 2, the openings 56 are positioned in spaced relationship around the burner tile 48 between the passageways 50 therein. Disposed within the passageways 56 are four secondary fuel discharge nozzles 60. The discharge nozzles 60 each include one or more discharge orifices 62 in the external ends thereof, and are each snugly fitted within a passageway 56. The internal ends of the nozzles 60 are connected to conduits 64 which extend through the passageways 56 of the burner tile 48, through the interior of the housing 12 and through complimentary openings 58 in the end wall 26 of the housing 12. The conduits 64 are connected to a pressurized fuel source by way of the conduit 42. As will be described further hereinbelow, the fuel nozzles 60 discharge fuel into the furnace space 21 wherein the fuel mixes with cool flue gases contained in the furnace space 21 and air remaining therein. The resulting mixture is burned in a secondary reaction zone in the furnace space 21 adjacent to and downstream from the primary reaction zone. More or less than four fuel nozzles 60 can also be utilized in the apparatus 10 based on known design considerations.

In the operation of the furnace of which the burner apparatus 10 is a part, fuel and air are discharged into the furnace space 21 and burned therein to form hot flue gases. The hot flue gases are cooled as they circulate through the furnace space 21 and lose heat prior to being vented to the atmosphere. In order to meet environmental emission standards, the flue gases must have low $NO_x$ content.

The required flue gases low $NO_x$ content is accomplished in accordance with the present invention by: (a) discharging into the furnace space 21 the air required for producing at least a substantially stoichiometric mixture of fuel and air therein by way of the opening 14 in the housing 12; (b) mixing, within the primary mixer-nozzle assembly 34, a portion of the total fuel needed for the required heat release within the furnace space 21 and flue gases from the furnace space 21 to thereby form a first fuel mixture, i.e., fuel diluted with flue gases; (c) discharging the first fuel mixture into the furnace space 21 by way of the orifices 54 of the nozzle 38 whereby the mixture combines with air discharged into the furnace space 21, the resulting fuel-flue gases-air mixture is burned in a primary reaction zone therein and flue gases having low $NO_x$ content are formed therefrom; and (d) discharging the remaining portion of the fuel by way of the nozzles 60 into a secondary reaction zone which sequentially follows the primary reaction zone in the furnace space 21 whereby the fuel combines with cooled flue gases from the furnace space 21, with the products of combustion from the primary reaction zone and with air in the furnace space 21 to form a second fuel mixture which is burned in the secondary reaction zone and additional flue gases having low $NO_x$ content are formed therefrom.

Referring to FIGS. 1 and 2, atmospheric air is introduced into the housing 12 of the burner apparatus 10 by way of the openings 28 therein and is discharged, in accordance with step (a) described above, through the open end 14 of the housing 12, through the open interior of the burner tile 48 and into the furnace space 21. As is well understood, the damper 30 is utilized to control the rate of total air introduced into the housing 12 at a level whereby at least a substantially stoichiometric mixture of total air and total fuel results in the furnace space 21.

In accordance with step (b), pressurized fuel flows by way of the conduit 40 into the primary mixer-nozzle assembly 34. The pressurized fuel, which can be fuel gas or vaporized liquid fuel, is formed into a high velocity jet as it enters the mixer 36 which causes a suction to be created at the flue gases inlet connections 46, the conduits 52 and the passageways 50. This in turn causes flue gases contained within the furnace space 21 to be drawn into the passageways 50 from the furnace space 21 and to flow by way of the conduits 52 to the mixer 36 wherein the flue gases are inspirated into and mixed with the fuel to form a first fuel mixture.

In accordance with step (c) described above, the first fuel mixture is discharged through the orifices 54 of the discharge nozzle 38 of the primary mixer-nozzle assembly 34 into a primary reaction zone adjacent thereto. Upon being discharged from the nozzle 38, the first fuel mixture combines with air flowing into the furnace space 21 by way of the open end 14 of the housing 12 and the interior of the burner tile 48 (as shown by the arrows 44), and the resultant flue gases-fuel-air mixture is burned in the primary reaction zone. Because the burning of the mixture takes place at a relatively low temperature due, at least in part, to the presence of the flue gases therein, the flue gases formed have a low $NO_x$ content. The term "relatively low temperature" is used herein to mean a temperature that is lower than the temperature at which the same fuel-air mixture, but undiluted with fuel gases, would burn.

Generally, the portion of fuel introduced into the primary mixer-nozzle assembly 34 and contained in the first fuel mixture discharged into the primary reaction zone is an amount in the range of from about 10% to about 50% by volume of the total fuel required. The flue gases which are drawn into and mixed with the fuel in the primary mixer-nozzle assembly 34 are preferably present in an amount in the range of from about 30% to about 400% by volume of the fuel depending on the composition of the fuel and other factors. As will be understood, the fuel utilized in a burner or furnace apparatus is normally expressed as a rate, i.e., a volume of fuel per unit time. The term "% by volume" as used herein means the stated % of the rate of fuel referred to. While the rate of the air discharged into the furnace space 21 can be varied, the rate of air utilized preferably results in an at least substantially stoichiometric fuel-air mixture. The term "stoichiometric fuel-air mixture" is used herein to mean a mixture in which the relative portions of fuel and air are such that when the mixture is burned to completion, no excess oxygen or fuel remains.

In accordance with step (d), the remaining portion of the fuel flows to the secondary nozzles 60 by way of the conduits 64 connected thereto and to the conduit 42. The fuel is discharged by way of the orifices 62 in the secondary nozzles 60 into the furnace space 21. That is, the portion of the fuel discharged by the secondary fuel nozzles 60 into the furnace space 21 mixes with air therein, with cooled flue gases contained within the furnace space 21 and with products of combustion, i.e., flue gases, from the primary reaction zone to form a second fuel mixture. Like the first fuel mixture, the second fuel mixture, at least in part as a result of the dilution thereof with flue gases, is burned in the secondary reaction zone at a relatively low temperature whereby the flue gases formed have a low $NO_x$ content.

Because the secondary fuel nozzles 60 are located adjacent to and downstream from the nozzle 38 of the primary mixer-nozzle assembly 34, the secondary reaction zone in which the second fuel mixture is burned sequentially follows the primary reaction zone in which the first fuel mixture is burned. Stated another way, the primary reaction zone extends from the primary nozzle 38 into the furnace space 21 and the secondary reaction zone substantially surrounds and extends outwardly from the primary reaction zone.

Figure 3:
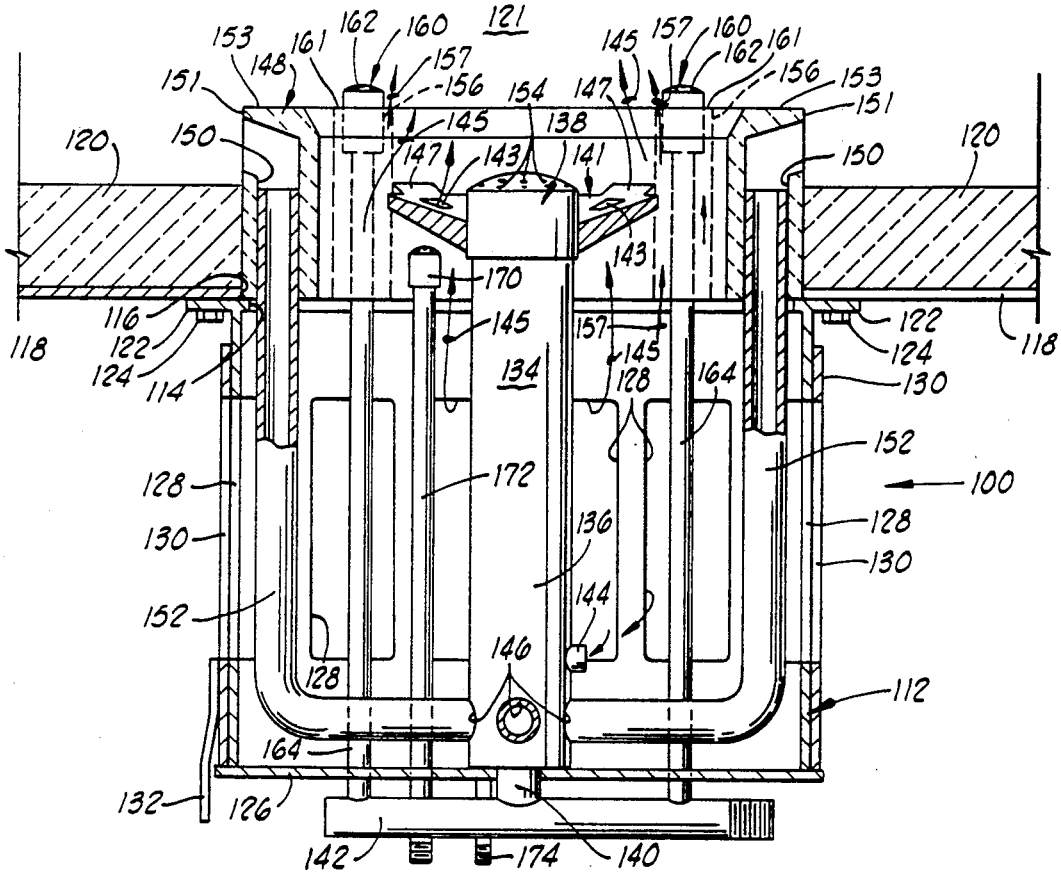
FIG. 3 is a side cross-sectional view of an alternate embodiment of the burner apparatus of the present invention attached to a furnace wall.
Figure 4:
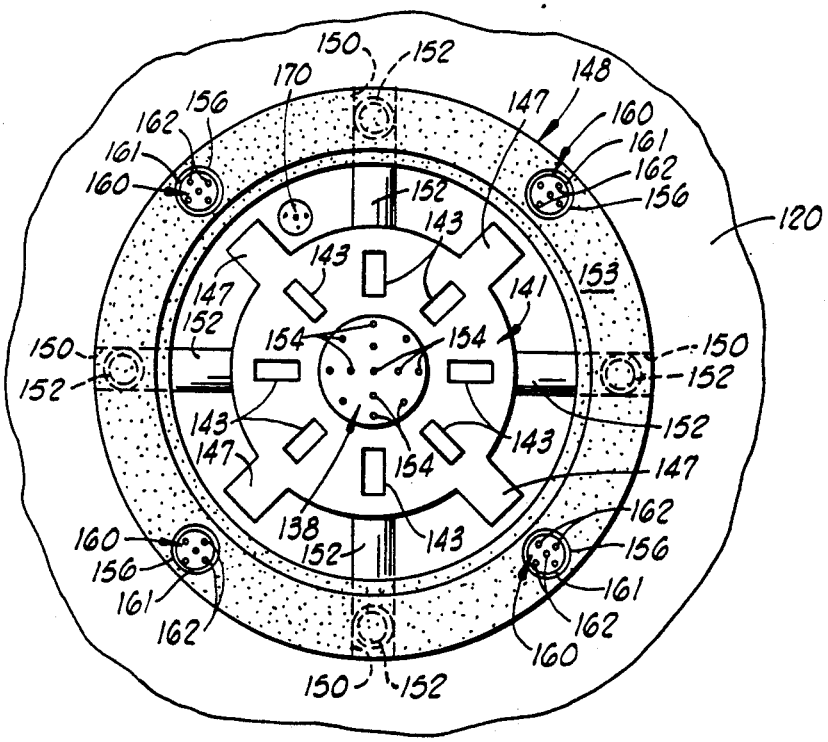
FIG. 4 is a top plan view of the burner and furnace wall of FIG. 3.

Referring now to FIGS. 3 and 4, an alternate embodiment of the burner apparatus of the present invention is shown and generally designated by the numeral 100. The burner 100 includes a cylindrical housing 112 which is connected at an open end 114 over a complimentary opening 116 in a furnace wall 118. An internal layer of insulation material 120 is provided adjacent the wall 118; and the wall 118, the insulation material 120 and a portion of the interior of a burner tile 148 define a furnace space 121 within which fuel and air are burned to form hot flue gases. The burner housing 112 includes an annular flange 122 at the open end 114 thereof which is bolted to the furnace wall 118 by a plurality of bolts 124. The opposite end of the housing 112 is closed by an end wall 126, and a plurality of air inlet openings 128 are disposed in spaced relationship around a cylindrical side of the housing 112. Like the burner apparatus 10, the apparatus 100 includes a cylindrical damper 130 rotatably positioned over the cylindrical side of the housing 112 having a handle 132 attached thereto.

A primary fuel jet mixer-discharge nozzle assembly generally designated by the numeral 134 is positioned co-axially within the housing 112. The assembly 134 is comprised of an elongated fuel jet mixture 136 connected to a discharge nozzle 138. The mixer 136 includes a pressurized fuel inlet connection to which a conduit 140 is connected. The conduit 140 is in turn connected to a source of pressurized fuel by a conduit 142. The primary mixer-nozzle assembly 134 also includes an air inlet 144, and four flue gases inlet connections 146 which are positioned in equally spaced relationship around the mixer 136.

In the embodiment illustrated in FIGS. 3 and 4, a conical shield 141 is attached to the nozzle 138 to enhance flame stability thereto. The shielding cone 141 is dish-shaped and includes a plurality of openings 143 formed therein for allowing the passage of a limited amount of air therethrough. The shielding cone 141 functions to create a protected area adjacent the nozzle 138 whereby air flowing in the direction indicated by the arrows 145 is deflected and instability of flame adjacent the nozzle 138 is reduced. The shielding cone 141 further includes tabs 147 extending therefrom towards and adjacent the secondary fuel nozzles 160 to be described further hereinbelow. The shielding tabs 147 function to enhance flame stability to the secondary fuel nozzles 160 by deflecting the flow of air in areas adjacent thereto.

An annular burner tile 148 is connected at the open end 114 of the housing 112. Like the burner tile 48 of the apparatus 10, the burner tile 148 includes four passageways 150 which extend from the inner end 149 thereof to the exterior side 151 within the furnace space 121. Connected to each of the flue gases inlet connections 146 of the mixer 136 are the ends of four conduits 152, the other ends of which extend into the passageways 150 formed in the burner tile 148. The four conduits 152 connect the four flue gases inlet connections 146 of the mixer 136 to the passageways 150 in the burner tile 148. The passageways 150 with the conduits 152 extending therein are positioned in equally spaced relationship around the primary mixer-nozzle assembly 134. The nozzle 138 of the primary mixer-nozzle assembly 134 includes one or more orifices 154 formed therein through which a fuel-air mixture diluted with flue gases is discharged into a primary reaction zone in the furnace space 121.

Four enlarged passageways 156 are disposed in the burner tile 148 extending from the inner end 149 thereof to the exterior end 153 thereof. The passageways 156 are positioned in spaced relationship around the burner tile 148 between the passageways 150 therein. Disposed within the passageways 156 are four secondary fuel discharge nozzles 160, each including one or more discharge orifices 162 in the external ends thereof. The nozzles 160 are connected by conduits 164 to the pressurized fuel conducting conduit 142. The diameters of the passageways 156 are sized with respect to the external sizes of the secondary fuel nozzles 160 such that annular air conducting conduits 161 are provided between the external surfaces of the nozzles 160 and the interiors of the passageways 156. Thus, as indicated by the arrows 157 in FIG. 3, air from within the housing 12 flows by way of the annular conduits 161 provided between the passageways 156 and the nozzles 160 into the secondary reaction zone above and adjacent to the secondary fuel nozzles 160. The particular rate of air which flows through the annular conduits 161 is controlled by the sizes of the annular conduits 161.

The fuel nozzles 160 discharge fuel into the furnace space 121 wherein the fuel mixes with the air entering the furnace space 121 by way of the annular conduits 161. As described above in connection with the burner apparatus 10, the fuel-air mixture combines with cool flue gases contained in the furnace space 121, products of combustion from the primary reaction zone and with any air remaining in the furnace space 121, and the resulting mixture is burned in a secondary reaction zone within the furnace space 121.

In order to further lower the production of $NO_x$ within the furnace space 121, a steam injection nozzle 170 connected to a steam conduit 172 is disposed within the housing 112. Alternatively the steam can be introduced into the primary mixer nozzle assembly 134 by way of a conduit 174 connected thereto. The steam injection contributes to low $NO_x$ production as is well known by those skilled in the art.

The operation of the apparatus 100 is similar to the operation of the apparatus 10 described above, except that a portion of the air which flows into the housing 112 by way of the openings 128 is drawn into the primary mixer-nozzle assembly 134, mixed with the fuel and flue gases therein and the resulting flue gases-fuel-air mixture is discharged into the furnace space 121 by way of the nozzle 138. In addition, a portion of the air within the housing 112 flows by way of the annular conduits 161 directly into the secondary reaction zone in the furnace space 121. More specifically, a portion of the total fuel needed for the required heat release is mixed within the primary mixer-nozzle assembly 134 with a portion of the total air required for at least the substantial stoichiometric combustion of the total fuel and with flue gases from the furnace space 21 to thereby form a first fuel-air mixture diluted with flue gases.

Generally, the portion of the total fuel which is introduced into the primary mixer-nozzle 134 and contained in the first fuel-air mixture diluted with flue gases discharged into the primary reaction zone is an amount in the range of from about 10% to about 50% by volume of the total fuel. The flue gases which dilute the first fuel-air mixture are preferably present therein in an amount in the range of from about 30% to about 400% by volume of the fuel in the fuel-air mixture depending on the composition of the fuel and other factors. The portion of the total air which is drawn into the mixer 136 by way of the air inlet 144 and which is contained in the first fuel-air mixture diluted with flue gases discharged into the furnace space 121 is an amount in the range of from about 50% to about 500% by volume of the fuel in the first fuel-air mixture depending on the composition of the fuel and other factors. As will be understood, the amounts of flue gases and air drawn into the mixer 136 are substantially set when the design of the burner apparatus 100 is finalized and the number and sizes of the various inlets, passageways, conduits, etc. are selected. However, some adjustments are normally possible.

The first fuel-air mixture diluted with flue gases is discharged into the furnace space 121 by way of the orifices 154 of the nozzle 138 whereby the mixture combines with a further portion of the total air which is discharged from the housing 112 into the furnace space 121 by way of the open end 114 of the housing 112 as illustrated by the arrows 145. The flow of air is deflected and slowed down adjacent the nozzle 138 by the shielding cone 141 to insure stability of the flame adjacent the burner 138 in the primary reaction zone. The resulting fuel-air mixture diluted with flue gases is burned in the primary reaction zone and flue gases are formed therein having low $NO_x$ content as a result at least in part of the presence of the diluting flue gases causing the burning to take place at a relatively low temperature.

The remaining portion of the fuel is discharged by way of the fuel nozzles 160 into a secondary reaction zone which sequentially follows the primary reaction zone. The discharged fuel combines with the air which is separately conducted to the secondary reaction zone by way of the annular conduits 161 formed within the passageways 156 around the nozzles 160. The air mixes with the fuel, with the products of combustion from the primary reaction zone and with cooled flue gases and any air contained in the furnace space to form a second fuel-air mixture diluted with flue gases. The second diluted fuel-air mixture is burned in the secondary reaction zone at a relatively low temperature thereby forming additional flue gases having a low $NO_x$ content.

Generally, the portion of the air which flows by way of the annular conduits 161 directly to the secondary reaction zone is an amount of air in the range of from about 10% to about 100% by volume of the fuel which is discharged into the secondary reaction zone by way of the nozzles 160.

Figure 5:
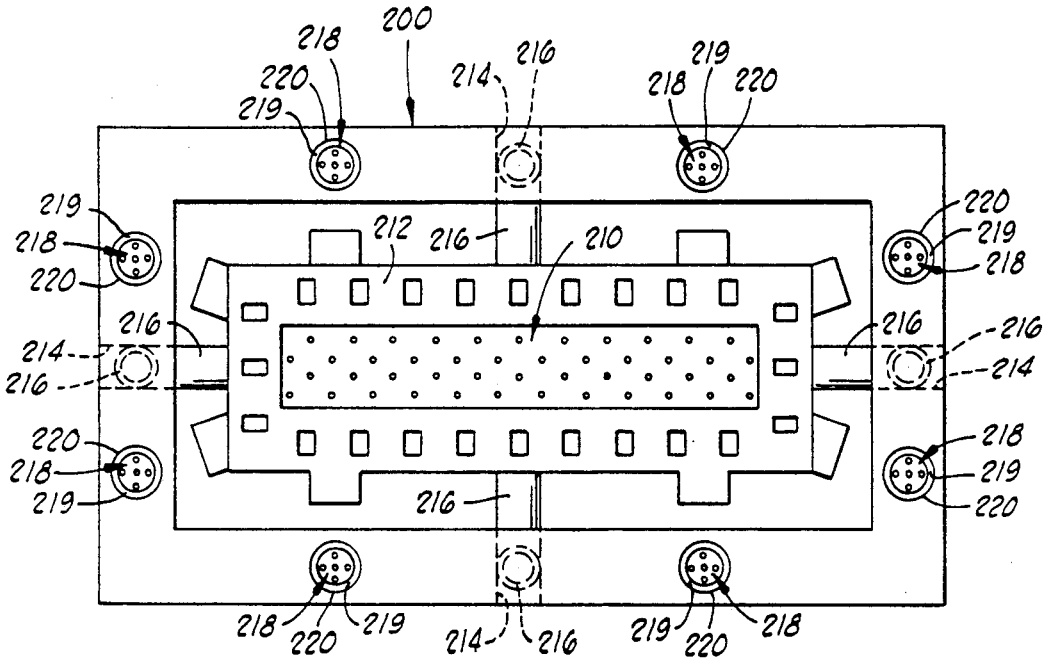
FIG. 5 is a top plan view of another alternate embodiment of the burner of the present invention.
Figure 6:
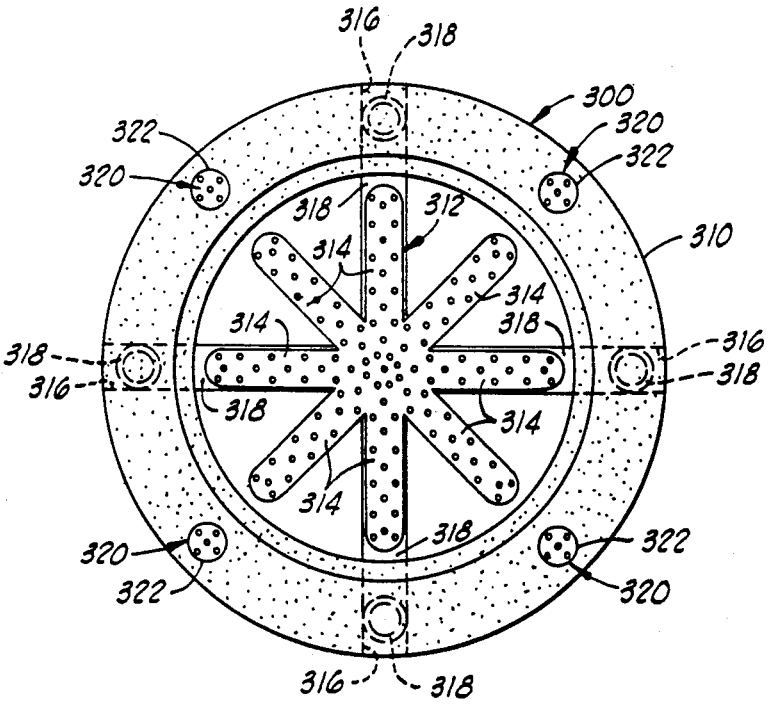
FIG. 6 is a top plan view of yet another alternate embodiment of the burner of the present invention.

Referring now to FIGS. 5 and 6, alternate forms of burner apparatus of the present invention are illustrated. Referring to FIG. 5, a rectangular shaped burner apparatus 200, often referred to as a flat flame burner, is illustrated. The burner apparatus 200 is generally the same design as the burner apparatus 100 described above except that it includes an elongated rectangular primary nozzle 210 with a rectangular shield 212 for providing flame stability attached thereto. Flue gases passageways 214 and conduits 216 are provided for drawing flue gases into the primary mixer-nozzle assembly, and a plurality of secondary fuel nozzles 218 are disposed in passageways 220. Air is discharged around the nozzles 218 by way of annular conduits 219 formed between the passageways 220 and nozzles 218. The passageways 214 and 220 are disposed in a rectangular burner tile 222 attached to the burner housing (not shown).

FIG. 6 illustrates another alternate form of burner apparatus of the present invention generally designated by the numeral 300. The apparatus 300 is similar to the apparatus 10 and includes a cylindrical burner tile 310 attached to a cylindrical burner housing (not shown). Instead of a circular burner nozzle with or without a flame stability shield the apparatus 300 includes a primary mixer-nozzle assembly wherein the nozzle 312 thereof includes a plurality of radially extending fingers 314. The configuration of the nozzle 312 is commonly referred to as a "spider" configuration. The apparatus 300 includes a plurality of flue gas intake passageways 316 and conduits 318 as well as a plurality of secondary fuel nozzles 320 disposed in passageways 322.

The burner apparatus 200 and 300 can include the structure and can be operated as described above in connection with the burner apparatus 10, or the burners 200 and 300 can include the structure and be operated as described above in connection with the burner 100, or various combinations of the structure and operation steps can be utilized depending upon the particular applications in which the burners are used. That is, for a particular application, a burner apparatus of the present invention may be rectangular, cylindrical or other shape, may or may not include a nozzle flame stabilizing shield, may or may not inspirate air into the primary mixer-nozzle assembly, may or may not separately conduct air directly to the secondary reaction zone or may or may not inject steam. Also, the apparatus may utilize natural air draft or forced air draft. The term "air" is used herein to mean atmospheric air, oxygen enriched atmospheric air or air which otherwise includes more or less oxygen therein than atmospheric air. The selection of a particular embodiment of the burner apparatus of this invention and its operation depends on the particular application in which the burner apparatus is used and various design considerations relating to that application which are well known to those skilled in the art.

In order to facilitate a clear understanding of the methods and apparatus of the present invention, the following examples are given.

EXAMPLE I

A burner apparatus 10 designed for a heat release of 10,000,000 BTU/hour by burning natural gas having a caloric value of 1,000 BTU/SCF is fired into the furnace space 21.

Pressurized fuel gas is supplied to the burner 10 at a pressure of about 30 PSIG and at a rate of 10,000 SCF/hour. A 30% by volume portion of the fuel (3,000 SCF/hour) flows into and through the primary mixer-nozzle assembly 34 wherein it is mixed with about 7,500 SCF/hour of flue gases (about 250% by volume of the fuel gas present in the mixture). The remaining portion of the fuel gas i.e., 7,000 SCF/hour flows from the conduit 42 to the four secondary fuel nozzles 60 from where the fuel gas is discharged into the furnace space 21. The rate of air introduced into the housing 12 is controlled by means of the damper 30 such that the total rate of air introduced into the furnace space 21 is an amount which results in at least a substantially stoichiometric total fuel-total air mixture therein.

The air flows through the open end 14 of the housing 12 into the furnace space 21 by way of the interior of the burner tile 48.

The fuel discharged from the secondary fuel nozzles 60 mixes with the remaining air, products of combustion (flue gases) from the primary reaction zone and relatively cool flue gases in the furnace space 21 to form a second combustion products and flue gases diluted fuel-air mixture which is burned in a secondary reaction zone adjacent to and surrounding the primary reaction zone in the furnace space 21.

Because of the dilution of the first and second fuel mixtures with flue gases, such mixtures burn at a relatively low temperature whereby the additional flue gases formed have a low $NO_x$ content. That is, the mixture of flue gases withdrawn from the furnace space 21 has a $NO_x$ content of less than about 25 ppm.

EXAMPLE II

A burner apparatus 100 designed for a heat release of 10,000,000 BTU/hour by burning natural gas having a caloric value of 1,000 BTU/SCF is fired into the furnace space 121.

Pressurized fuel-gas is supplied to the burner 100 at a pressure of about 30 PSIG and at a rate of 10,000 SCF/hour. A 30% by volume portion of the fuel (3,000 SCF/hour) flows into and through the primary mixer-nozzle assembly 34 wherein it mixes with 3,000 SCF/hour of air and about 7,500 SCF/hour of flue gases. The portion of the total air mixed with the fuel gas in the primary mixer-nozzle assembly and discharged therefrom results in a sub-stoichiometric fuel-air mixture.

The first flue gases diluted fuel-air mixture discharged from the nozzle 138 mixes with additional air flowing into the furnace space 121 by way of the open end 114 of the housing 112. The resulting mixture is burned in the primary reaction zone, and because, at least in part of the presence of flue gases, the additional flue gases produced have a low $NO_x$ content.

The remaining portion of fuel, i.e., 7,000 SCF/hour, flows to the nozzles 160 from where the fuel gas is discharged into a secondary reaction zone within the furnace space 121. A 1,000 SCF/hour amount of air is conducted directly to the secondary reaction zone by way of the annular conduits 161. The air flows from the annular conduits 161, mixes with the fuel discharged from the nozzles 160, mixes with products of combustion (flue gases) from the primary reaction zone and mixes with relatively cool flue gas and any air contained in the furnace space 121 to form a second products of combustion and flue gases diluted fuel-air mixture which is burned in the secondary reaction zone at a relatively low temperature.

The mixture of flue gases formed in the furnace space 121 and withdrawn therefrom has a $NO_x$ content of less than about 25 ppm.

Thus, the present invention is well adapted to carry out the objects and attain the advantages mentioned as well as those inherent therein. While presently preferred embodiments of the invention have been described for purposes of this disclosure, numerous changes in construction and in the arrangement of parts and steps will suggest themselves to those skilled in the art which are encompassed within the spirit of this invention as defined by the appended claims.

What is claimed is:

1. An improved burner apparatus for discharging a mixture of fuel and air into a furnace space wherein said mixture is burned and flue gases having low $NO_x$ content are formed therefrom comprising:

a housing having an open end attached to said furnace space;

means for introducing a controlled quantity of air into said housing and into said furnace space attached to said housing;

primary mixer-nozzle means for mixing fuel with flue gases from said furnace space and discharging the resulting mixture into the open end of said housing and into said furnace space disposed within said housing, said primary mixer-nozzle means including a pressurized fuel inlet for connection to a source of pressurized fuel;

flue gases passageway means disposed in said housing extending into said furnace space whereby flue gases from within said furnace space are drawn into said passageway means and conducted to said primary mixer-nozzle means thereby; and at least one secondary fuel nozzle means attached to said housing having a pressurized fuel inlet for connection to a source of pressurized fuel for introducing additional fuel into said furnace space which mixes with flue gases and air therein.

2. An improved burner apparatus for discharging a mixture of fuel and air into a furnace space wherein said mixture is burned and flue gases having low $NO_x$ content are formed therefrom comprising:

a housing having an open end attached to said furnace space;

means for introducing a controlled quantity of air into said housing and into said furnace space;

fuel jet mixer means for mixing fuel with flue gases from said furnace space and discharging the resulting mixture into the open end of said housing and into a primary reaction zone in said furnace space adjacent thereto, said fuel jet mixer means being attached to said housing and including a conduit for connection to a source of pressurized fuel having a fuel gas jet forming end, and at least one flue gases passageway communicating said fuel jet forming end of said conduit with flue gases in said furnace space and with the interior of said housing whereby flue gases from within said furnace space are drawn into said passageway, mixed with fuel and discharged into said housing; and at least one secondary fuel nozzle means attached to said housing for connection to a source of pressurized fuel and for introducing additional fuel into said furnace space.

3. The apparatus of claim 2 wherein the open end of said housing is an annular burner tile formed of flame and heat resistant material.

4. The apparatus of claim 3 wherein said flue gases passageway is at least partially comprised of a passageway disposed in said burner tile.

5. The apparatus of claim 4 wherein said secondary fuel nozzle means extends into another passageway disposed in said burner tile.

6. The apparatus of claim 5 wherein a flame stability shield having a plurality of openings therein is disposed within the interior of said annular burner tile.

7. The apparatus of claim 6 wherein said flame stability shield is dish-shaped.

8. A method of discharging an at least substantially stoichiometric mixture of fuel and air into a furnace space wherein said mixture is burned and flue gases having low $NO_x$ content are formed therefrom comprising the steps of:

discharging said air into said furnace space;

mixing a portion of said fuel with flue gases from said furnace space to form a fuel and flue gases mixture;

discharging said fuel and flue gases mixture into said furnace space whereby said mixture combines with air and is burned in a primary reaction zone therein and flue gases having low $NO_x$ content are formed therefrom; and discharging the remaining portion of said fuel into a secondary reaction zone in said furnace space whereby said fuel mixes with flue gases and air contained in said furnace space and is burned in said secondary reaction zone.

9. The method of claim 8 wherein said secondary reaction zone sequentially follows said primary reaction zone in said furnace space.

10. The method of claim 8 wherein said fuel and flue gases mixture discharged and burned in said primary reaction zone is formed by a fuel jet mixer.

11. The method of claim 9 wherein said remaining portion of fuel is discharged into said secondary combustion zone by way of at least one secondary fuel nozzle.

12. The method of claim 11 wherein said remaining portion of fuel is discharged into said secondary combustion zone by way of a plurality of secondary fuel nozzles.

13. The method of claim 8 wherein said portion of said fuel contained in said fuel and flue gases mixture discharged and burned in said primary reaction zone is an amount in the range of from about 10% to about 50% by volume of the total fuel discharged into said furnace space, and said flue gases in said fuel mixture are present therein in the range of from about 30% to about 400% by volume of said fuel in said mixture.

* * * * *